US007966778B2

(12) United States Patent
Klein

(10) Patent No.: US 7,966,778 B2
(45) Date of Patent: Jun. 28, 2011

(54) DEVICE FOR THE EARTHQUAKE-RESISTANT MOUNTING OF A PARTITION

(75) Inventor: Jean-Pierre Klein, Clamart (FR)

(73) Assignee: Placoplatre, Suresnes (FR)

( * ) Notice: Subject to any disclaimer, the term of this patent is extended or adjusted under 35 U.S.C. 154(b) by 636 days.

(21) Appl. No.: 10/581,341

(22) PCT Filed: Dec. 3, 2004

(86) PCT No.: PCT/FR2004/003108

§ 371 (c)(1),
(2), (4) Date: Jun. 2, 2006

(87) PCT Pub. No.: WO2005/056946

PCT Pub. Date: Jun. 23, 2005

(65) Prior Publication Data

US 2007/0107325 A1 May 17, 2007

(30) Foreign Application Priority Data

Dec. 5, 2003 (FR) ..... 03 14286

(51) Int. Cl.
*E04B 2/82* (2006.01)

(52) U.S. Cl. ..... 52/126.3; 52/167.1; 52/481.2

(58) Field of Classification Search ..... 52/126.3, 52/167.1, 243.1, 481.1, 481.2
See application file for complete search history.

(56) References Cited

U.S. PATENT DOCUMENTS 3,049,195 A * 8/1962 Leat et al. ..... 52/126.4
3,292,328 A * 12/1966 Darling et al. ..... 52/238.1
3,381,438 A * 5/1968 Bohnsack ..... 52/481.2
3,492,766 A * 2/1970 Andrews ..... 52/36.6
3,566,559 A * 3/1971 Dickson ..... 52/126.4
3,609,933 A * 10/1971 Jahn et al. ..... 52/461
3,665,837 A * 5/1972 Balfanz, Jr. ..... 454/303

(Continued)

FOREIGN PATENT DOCUMENTS

DE 28 36 126 2/1980

(Continued)

OTHER PUBLICATIONS

English translation of Japanese Office Action dated Jul. 7, 2009.

*Primary Examiner* — Jeanette E Chapman
*Assistant Examiner* — Daniel Kenny
(74) *Attorney, Agent, or Firm* — Young & Thompson

(57) ABSTRACT

Device for the earthquake-resistant mounting of a partition between a floor (2) and a ceiling (4). The partition includes: a frame having (i) a lower runner (8) and an upper runner (10) which are essentially horizontal, and (ii) essentially-vertical studs which connect the upper and lower runners; and a coating (6) which is fixed to the frame. The device includes: a contoured slide (18) which is intended to be solidly connected to the upper runner (10) and which has an essentially-U-shaped cross-section, and a top rail (30) which is intended to be fixed to the ceiling (4) and partially housed in the slide (18) between the arms of the U-shaped section thereof. The slide (18) and the top rail (30) are mounted such that they can move vertically in relation to one another. In addition, reversible detent elements are also provided between the slide (18) and the top rail (30).

17 Claims, 2 Drawing Sheets

U.S. PATENT DOCUMENTS

| | | | | |
|---|---|---|---|---|
| 3,805,471 | A * | 4/1974 | De Schutter | 52/714 |
| 4,103,463 | A * | 8/1978 | Dixon | 52/126.4 |
| 4,905,428 | A * | 3/1990 | Sykes | 52/126.4 |
| 4,914,880 | A * | 4/1990 | Albertini | 52/243 |
| 4,918,899 | A * | 4/1990 | Karytinos | 52/690 |
| 5,127,203 | A * | 7/1992 | Paquette | 52/241 |
| 5,315,804 | A * | 5/1994 | Attalla | 52/481.1 |
| 5,524,402 | A * | 6/1996 | Sykes | 52/243.1 |
| 5,735,100 | A * | 4/1998 | Campbell | 52/645 |
| 5,913,788 | A * | 6/1999 | Herren | 52/241 |
| 6,058,668 | A * | 5/2000 | Herren | 52/241 |
| 6,076,322 | A * | 6/2000 | D'Andrea et al. | 52/481.1 |
| 6,122,871 | A * | 9/2000 | Russell et al. | 52/243.1 |
| 6,360,510 | B1 * | 3/2002 | Woodrum et al. | 52/481.1 |
| 6,374,558 | B1 * | 4/2002 | Surowiecki | 52/241 |
| 6,807,784 | B2 * | 10/2004 | Hsueh | 52/481.2 |
| 7,127,862 | B2 * | 10/2006 | Saldana | 52/715 |
| 7,178,304 | B2 * | 2/2007 | Brady | 52/653.1 |
| 2001/0029712 | A1 * | 10/2001 | Emaus et al. | 52/239 |
| 2002/0121056 | A1 * | 9/2002 | Von Hoyningen Huene et al. | 52/241 |
| 2002/0157335 | A1 * | 10/2002 | Vos | 52/238.1 |

FOREIGN PATENT DOCUMENTS

| | | |
|---|---|---|
| JP | 53-48317 | 5/1978 |
| JP | 5-34213 U | 5/1993 |
| JP | 9-256521 | 9/1997 |
| JP | 2000-320050 | 11/2000 |

* cited by examiner

DEVICE FOR THE EARTHQUAKE-RESISTANT MOUNTING OF A PARTITION

BACKGROUND OF THE INVENTION

The present invention relates to a device for the earthquake-resistant mounting of a partition, in particular a partition of plaster boards, as well as to a partition made with such a device.

A partition of plaster boards is generally mounted on a metal structure termed "framework" hereinafter. The mounting of a vertical partition between a floor and a horizontal ceiling is considered here. The metal structure mentioned then conventionally comprises an upper rail fixed to the ceiling, a lower rail disposed in the same vertical plane as the upper rail and fixed onto the floor, as well as vertical uprights regularly spaced apart and each fixed by their ends onto the upper and lower rails. The plaster boards are then mounted on the vertical uprights and also the horizontal rails (upper and lower), for example by screwing.

Such a partition, in the unloaded state, performs satisfactorily during tests on earthquake resistance provided the attachments to the ceiling and floor are reinforced. However, when it is loaded, that is to say when loads (furniture, various equipment, etc.) are fixed onto the partition, its resistance must be verified.

SUMMARY OF THE INVENTION

The object of the present invention therefore is to provide a device for the earthquake-resistant mounting of a partition enabling a partition, even when loaded, to resist the stresses undergone during an earthquake. The partition is advantageously easy to mount. Preferably the device also makes it possible to keep the fire-resistant and acoustic properties of a similar "conventionally" constructed partition, and the additional cost of the device is limited with respect to a conventional assembly.

To that end, it provides a device for the earthquake-resistant mounting of a partition between a floor and a ceiling, said partition having a framework comprising a lower rail and an upper rail that are substantially horizontal and uprights that are substantially vertical connecting the upper and lower rails, as well as a covering fixed to said framework.

According to the invention, this device comprises a slide of profiled section, the slide being adapted to be joined to the upper rail and having a substantially U-shaped section, and a top runner adapted to be fixed to the ceiling and partially housed in the slide between the arms of its U-section, the slide and top runner being mounted such that they are able to move relative to each other in a vertical direction and reversible snap-fitting means being provided between the slide and the top runner.

This device enables the upper rail to be uncoupled from the ceiling. When the device is implemented to produce a partition, the upper rail receiving the covering is not connected to the ceiling but is connected to a member (termed slide here) which can be moved vertically with respect to a holding and guiding member (termed top runner here) itself fixed to the ceiling. Such a device may thus be placed adjacent to a ceiling, at the top of a partition, to enable the latter to take the accelerations undergone during an earthquake without damage, or at least to limit the damage. During the mounting of the partition, the snap-fitting means provided on the slide and on the top runner may be engaged such that the slide is held onto the top runner. As these snap-fitting means are reversible, when stress is applied due for example to an earthquake or to a change in load, the slide can move with respect to the top runner.

In one embodiment, the top runner is for example in the form of a rail of profiled section comprising two side flanges extending parallel to the arms of the U-section of the slide and within those arms. Here the top runner is substantially in the form of a rail of profiled section of the type used as upper rail. Preferably, each of the side flanges of the top runner and each of the arms of the U-section of the slide comprises a boss projecting inwardly respectively from the flanges and from the arms, the bosses of the slide being adapted, when in resting position, to locate in the bosses of the top runner. In this variant embodiment, the slide may come into snap-fitting engagement on the top runner when the latter is fixed to the ceiling. This facilitates the assembly of the partition, or more particularly of its framework, since it is not necessary to support the slide and the upper rail which is joined to it, during the installation of the vertical uprights which afterwards receive the covering boards. The bosses made in the slide and in the top runner may be continuous and thus form grooves over the entire length of the corresponding members or else be discrete and therefore form a discontinuous pattern over the slide and the top runner. However, to allow relative longitudinal sliding between the top runner and the slide during mounting, the bosses made on the top runner preferably form a continues groove.

To avoid the covering boards rising up to the ceiling during formation of a partition, the slide advantageously comprises at each free end of the arms of its U-section a rim extending outwardly of the U, substantially perpendicular to the arms of the U. During implementation of the device, the covering boards then come into abutment with those rims. This also enables an aesthetic finish of good quality to be provided at the top of the partition. To improve the finish, the device advantageously further comprises an elastic joint adapted to be located between a rim of the slide and the ceiling on which the top runner is fixed. This joint enables the gap appearing between the top of the covering and the ceiling to be hidden.

The top runner is for example a member of profiled section comprising two side flanges slidingly mounted between the arms of the U-section of the slide and also a housing, disposed between the side flanges, on the opposite side from the slide, and adapted to receive a material having fire-retardant properties. This form of top runner is advantageous since it enables fire resistance to be maintained despite the discontinuity of the covering which appears adjacent the ceiling. The presence of a material in said housing also enables soundproofing to be provided between the two walls of the partition improving the sound insulation performance of the partition.

When it is intended for the production of a partition adapted to be loaded, the device according to the invention advantageously further comprises at least one anchorage reinforcing member disposed in the top runner to improve the resistance of that partition in relation to forces that are normal (with respect to the plane of the partition). Said anchorage reinforcing member may for example be constituted by a U-section member disposed transversely with respect to the slide and the top runner.

The mounting described above for the connection of a partition to a ceiling may also apply to a connection between a substantially vertical side wall and the partition. In this case, a device is provided for the earthquake-resistant mounting of a partition between a floor and a vertical wall, said partition having a framework comprising a lower rail and an upper rail that are substantially horizontal and uprights that are substantially vertical connecting the upper and lower rails, as well as a covering fixed to said framework.

According to the invention, this device comprises a slide of profiled section, the slide being adapted to be joined to a vertical side rail and having a substantially U-shaped section, and a vertical runner adapted to be fixed to the corresponding vertical wall and partially housed in the slide between the arms of its U-section, the slide and the vertical runner being mounted such that they are able to move relative to each other in a horizontal direction and reversible snap-fitting means being provided between the slide and the vertical runner.

The present invention also relates to a partition having a framework comprising a lower rail and an upper rail that are substantially horizontal and uprights that are substantially vertical connecting the upper and lower rails, as well as a covering fixed onto said framework, characterized in that the framework further comprises a device as described above.

This partition is preferably such that the covering is fixed at its upper portion so as not to extend beyond the slide, thus leaving a free space between the covering and the ceiling, it being possible for said space to be filled by a joint of elastic material. In this manner, the covering of the partition is uncoupled from the ceiling and can be rendered "floating" with respect to the ceiling. To improve the disconnection of the covering boards from the structure of the building, said boards are advantageously also mounted so as to be floating with respect to the lower rail.

For reasons of aesthetics in particular, provision can be made for a flexible mastic joint to be made between the floor and the covering fixed to the framework.

For improved strength properties with respect to accelerations normal to the plane of the partition, at least one anchorage reinforcing member is for example disposed transversely in the lower rail.

The present invention also provides a partition as described above which further comprises:

two substantially vertical side edges, each associated with a substantially vertical side rail, and at least one device for the mounting of said partition on a substantially vertical wall, which mounting device comprises a slide of profiled section, the slide being adapted to be joined to the side rail and having a substantially U-shaped section, and a vertical runner adapted to be fixed to the corresponding vertical wall and partially housed in the slide between the arms of its U-section, the slide and the vertical runner being mounted such that they are able to move relative to each other in a horizontal direction and reversible snap-fitting means being provided between the slide and the vertical runner.

For such a partition, an earthquake-resistant mounting device according to the invention is to be found on at least two edges of the partition, the upper edge and a side edge. According to a preferred embodiment, such an earthquake-resistant mounting device is formed on the two side edges of the partition. The latter is then equipped with such a device on three edges.

BRIEF DESCRIPTION OF THE DRAWINGS

Details and advantages of the present invention will appear more clearly from the following description, made with respect to the accompanying drawings in which.

DETAILED DESCRIPTION OF THE PREFERRED EMBODIMENTS

Figure 1:
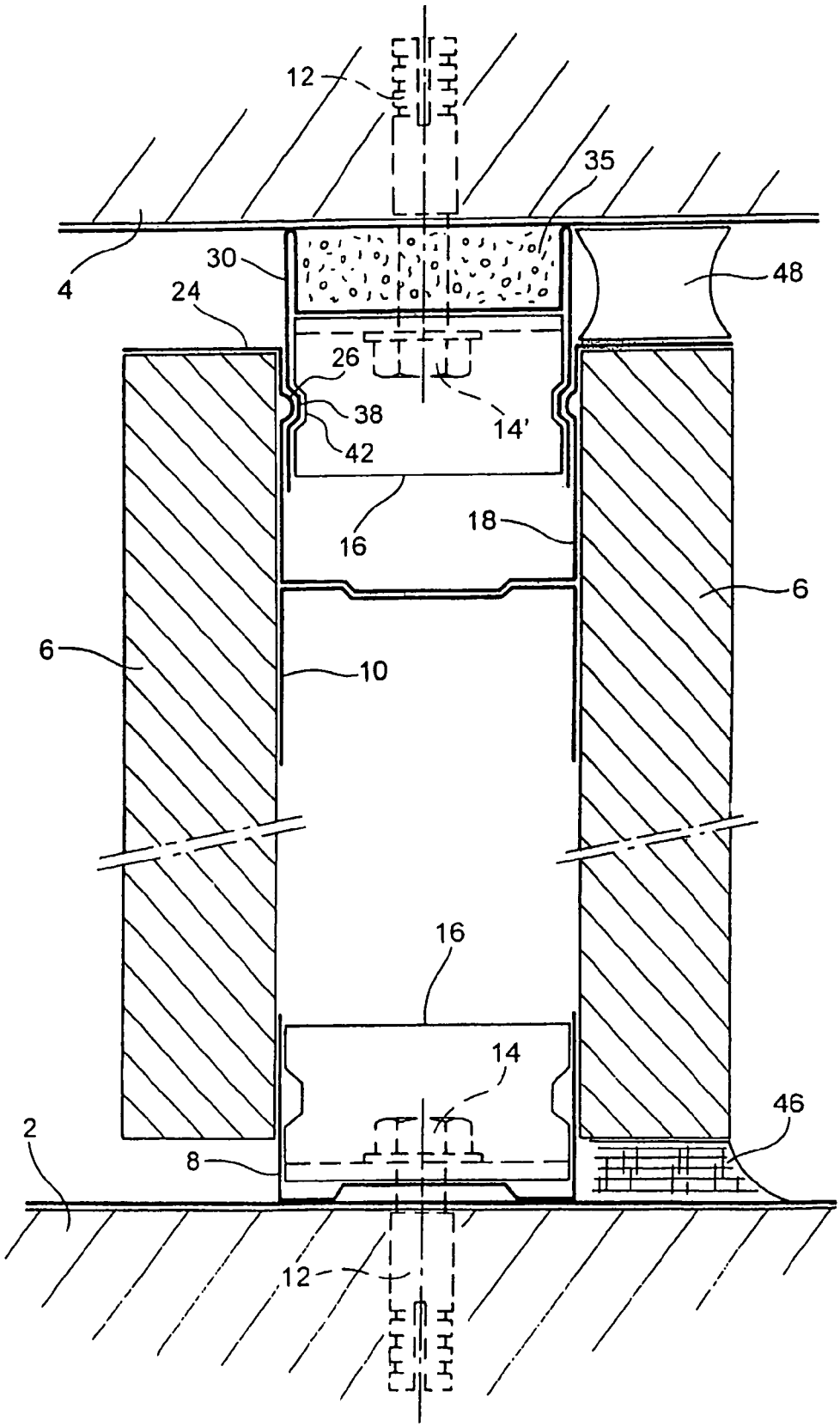
FIG. 1 is a cross-section of a partition according to the invention.

FIG. 1 shows a partition according to the invention in transverse cross-section. This partition is a vertical partition disposed between a floor 2 and a ceiling 4 which form two horizontal planar surfaces. The partition comprises both a framework and plaster covering boards 6. The latter are fixed to the framework in conventional manner known to the person skilled in the art, for example using screws that are not shown. The covering boards 6 may be of any particular thickness. However, in the case in which the partition is adapted to be loaded, that is to say that furniture or other things are fixed to the partition, the boards are preferably of relatively great thickness, for example of the order of 25 mm.

The framework of the partition comprises a lower rail 8 and an upper rail 10 in conventional manner. The lower rail 8 is a rail of U-section profile and is fixed to the floor 2. The base of the U of the rail of profiled section is directed towards the floor 2 whereas the arms of the U of that rail extend towards the upper rail 10 and the ceiling 4.

Since the partition is adapted to resist shaking of an earthquake, the anchoring of the lower rail 8 is preferably achieved using expanding metal plugs 12 of a diameter for example of 8 mm. Screws 14 of corresponding diameter are then used to cooperate with the plugs 12 and fix the lower rail 8 into the floor 2. Relatively small spacing between the plugs 12 may also be provided, for example of the order of 50 to 60 cm.

Figure 4:
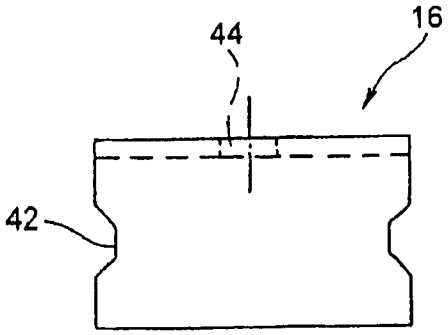
FIG. 4 is a side view of a anchorage reinforcing member used in the partition of FIG. 1.
Figure 5:
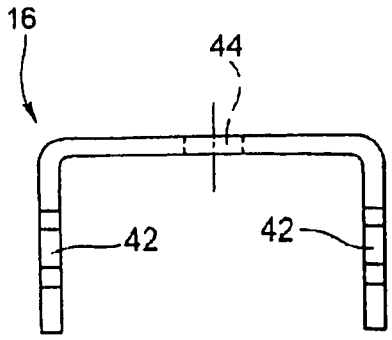
FIG. 5 is a view from the front of the anchorage reinforcing member of FIG. 4.

As shown in the drawing, the screw 14 holding the lower rail 8 also fixes an anchorage reinforcing member 16. The latter is best represented in FIGS. 4 and 5. It is for example made from galvanized steel of a thickness of 2 mm and is in the form of a U-section member. This profiled section member is transversely oriented with respect to the lower rail 8. It locates between the arms of the lower rail 8 and prevents them from bending inwardly of the lower rail 8. As shown by FIG. 1, the length of the anchorage reinforcing member 16, which can be seen in FIGS. 1 and 4, substantially corresponds to the width of the lower rail 8 between the arms thereof.

Figure 3:
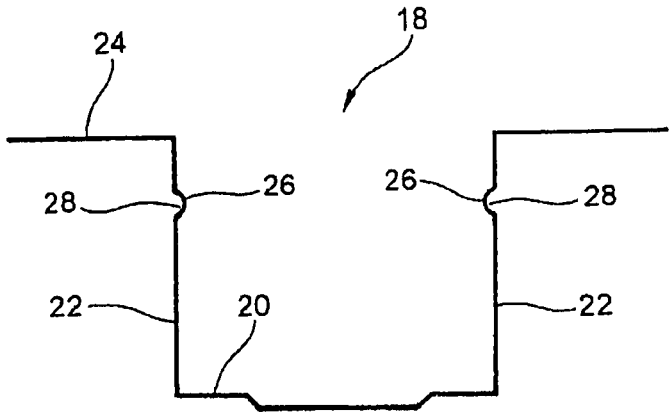
FIG. 3 is a transverse cross-section of the slide used in the partition of FIG. 1.

The upper rail 10 is identical to the lower rail 8. It is disposed parallel to the lower rail 8 and both are in the same vertical plane corresponding to the plane of the partition. In a conventional partition construction, the upper rail 10 is fixed to ceiling 4. In the partition according to the invention represented in the drawing, the upper rail 10 is connected to a slide 18 represented in isolation in FIG. 3 and described below.

The slide 18 is in the form of a U-section member, for example of galvanized steel, comprising a base 20, side arms 22 and rims 24.

The base 20 is of complementary form to that of the profiled section member of the upper rail 10. The latter is preferably a commercially available rail. It is for example a rail of outer width 48 mm. Such a rail for example comprises a groove for stiffening. In the embodiment represented in the drawing the base 20 thus comprises a groove that is complementary so as to follow the form of the upper rail 10. The groove naturally also serves to stiffen the slide 18.

The side arms 22 extend substantially perpendicular to the base 20. They are located in a vertical plane when the slide 18 is in place in the partition and extend in line with the arms of the U of the upper rail 10. The two U-section members are thus located back to back: the upper rail 10 with its arms extending downwardly (or towards the floor 2) and the slide 18 with its side arms 22 extending upwardly (or towards the ceiling 4).

The rims 24 extend perpendicular to the side arms 22 and are thus located in a substantially horizontal plane, parallel to the ceiling 4, when the slide 18 is in place in the partition represented in the drawing. The rims 24 are attached at the end of the side arms 22 opposite from the base 20.

It will be noted that on each side arm 22 a boss 26 projects inwardly from the arms. The boss 26 extends over the entire length of the profiled section member constituting the slide 18. The two bosses 26 are located at the same height with respect to the base 20, i.e. they face each other. They are disposed in the upper third of the slide 18, the base 20 forming the lower part of that slide given the orientation of the slide 18 in the partition. On the outer surface of the side arms 22 a corresponding longitudinal groove 28 is to be found at the same height as the bosses 26.

While in this embodiment the bosses 26 form a rib on one face of the side arms 22 and a groove 28 on the opposite faces extending over the entire length of the slide 18, it can also be envisaged to provide localized bosses 26. In this other embodiment there is thus a series of bosses 26 on each side arm 22. The bosses may then take various forms: points, dashes, etc.

The space defined between the side arms 22 of the slide 18 is adapted to partly receive a top runner 30. The latter is represented in isolation in FIG. 2. It takes the form of a profiled section member adapted to be fixed to the ceiling 4.

Figure 2:
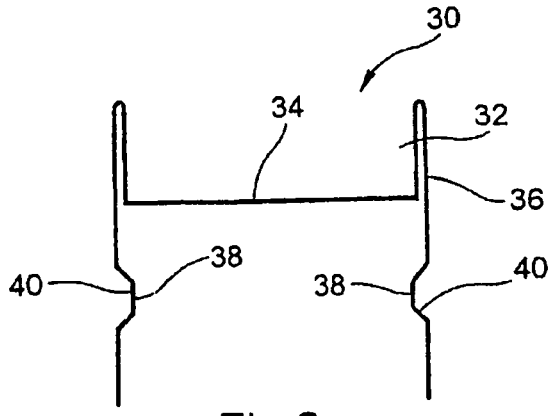
FIG. 2 is a transverse cross-section of the top runner used in the partition of FIG. 1.

The top runner 30 also takes the form of a U-shaped profile section member here even though the shape in FIG. 2 is reminiscent of that of an I. This is because it is considered here that the top runner 30 has a base 32 in which a rabbet 34 is formed in order to be able to accommodate material having fire-retardant properties. This material is in the form of a member commonly referred to as protective strip 35 and represented in FIG. 1. The top runner 30 is for example made from galvanized steel.

The base 32 is disposed against the ceiling 4 and used for fixing the top runner 30 to the ceiling 4. This fixing is achieved with the use of expanding metal plugs 12 identical to the plugs 12 used for fixing the lower rail 8, together with screw 14' of a diameter adapted to the plug and of length adapted in particular to the thickness of the base 32 of the top runner 30.

The top runner 30 comprises side flanges 36 which extend over the entire height of the base 32 and form the arms of the U of the profiled section member constituting the top runner 30. These side flanges 36, when the top runner 30 is fixed to the ceiling 4, extend in a plane that is vertical to the floor 2. The width of the top runner 30 outside of the side flanges 36 is slightly less than the inside width of the slide 18, between the side arms 22.

On each of the side flanges 36 a boss 38 is also to be found in the same way as for the side arms 22. Longitudinal grooves 40 on the outer faces of the side flanges 36 correspond to these bosses 38. The bosses 38 and the corresponding grooves 40 are disposed at the same height with respect to the base 32 and face each other. They are for example disposed at mid-height between the base 32 and the free ends of the side flanges 36. In assembled resting position, the longitudinal grooves 40 of the side flanges 36 receive the bosses 26 of the slide 18, as shown in FIG. 1.

Whereas the bosses 26 may be localized and/or form a discontinuous rib (and corresponding groove), the grooves 40 corresponding to the bosses 38 are preferably continuous. In this way, the slide 18 can move longitudinally with respect to the top runner 30 during assembly. However, as for the bosses 26, it can be envisaged to have discrete i.e. non-continuous bosses 38.

It may also be noted in FIG. 1 that an anchorage reinforcing member 16 is used for fixing the top runner 30 to the ceiling 4. This anchorage reinforcing member 16 locates between the side flanges 36 of the top runner 30. In order to be adapted to the shape of those flanges and in particular to the presence of the bosses 38, the anchorage reinforcing member 16 has, at each of its ends, on each of its flanges, a cut-out 42. The cut-outs 42 are made in such a manner that when the anchorage reinforcing member 16 is placed between the side flanges 36 of the top runner 30, the base of the anchorage reinforcing member 16 being back to back with the base 32 of the top runner 30, the cut-outs 42 receive the bosses 38 made on the inside face of the side flanges 36.

To perform the assembly of an earthquake-resistant partition according to the invention, it is possible for example to proceed as follows. Initially, the lower rail 8 is fixed to the floor 2. Plugs 12 have been placed in the floor 2 in advance, with a regular spacing, for example every 50 or 60 cm. At each point of fixation of the lower rail 8 a screw 14 acts to hold the lower rail 8 by engaging in a corresponding plug 12. A anchorage reinforcing member 16 may be provided adjacent each screw 14 or else every two screws. A bore 44 is provided in the base of each anchorage reinforcing member 16 for the passage of the screw 14 (or 14').

In top position, the top runner 30 is fixed to the ceiling 4 in a substantially similar manner. Plugs 12 are regularly anchored into the ceiling 4 with for example the same spacing as the plugs 12 of the lower rail 8 and the top runner 30 is fixed using screws 14'. Before fixing the top runner 30 against the ceiling 4, the protective strip 35 is put into place in the rabbet 34 where the partition is required to satisfy standards of fire resistance. The screws 14' then pass through the protective strip 35. As for the installation of the lower rail 8, provision may be made for putting in place anchorage reinforcing members 16 in the top runner 30 held by each of the screws 14' or else by one screw 14' out of every two (any other arrangement of the reinforcing members may be envisaged). By virtue of the presence of the cut-outs 42 cooperating with the bosses 38 of the top runner 30, the anchorage reinforcing members 16 are held in the top runner 30 during screwing up of the screws 14'.

Once the top runner 30 is in place, the upper rail 10 is fixed onto the slide 18. This assembly is for example performed by screwing. The assembly so formed by the slide 18 and the upper rail 10 snap-fits onto the top runner 30. The bosses 26 of the slide 18 come into position in the outer longitudinal grooves 40 of the side flanges 36 of the top runner and enable the assembly of the slide 18 and the upper rail 10 to be held onto the top runner 30 without any accessory of screw or other type. The vertical uprights (not shown) may then come into position in a conventional manner between the lower rail 8 and the upper rail 10.

The framework of the partition is then in place. The covering boards 6, for example plaster boards, may be held in place in a conventional manner for example by screwing to the framework. However, the boards float with respect to the lower rail 8, i.e. no fixing of the boards to the lower rail is provided. The covering boards 6 are mounted in such a manner that they do not come into contact with the floor 2 and ceiling 4. At the floor, as shown in the drawing (FIG. 1), a space of a few millimeters is left free between the boards and the floor 2. A mastic joint 46 fills the space left free.

Adjacent the ceiling, the covering boards 6 come into abutment with the rims 24 of the slide 18 and so remain spaced from the ceiling 4. A space of for example the order of 15 mm between the covering boards 6 and the ceiling is provided. The rims 24 of the slide 18 enable an upper limit to be defined which the covering boards must not extend beyond. In the absence of those rims 24, assembly instructions may be provided indicating that the covering boards must not extend beyond the slide 18.

For aesthetic reasons, in order to avoid a visible groove in the upper portion of the partition, an elastic joint 48, for example of "Neoprene", may be provided to fill the space left free between the rims 24 (or the upper edge of the covering boards 6) and the ceiling. This elastic joint 48 may be painted or covered in such a manner as to be concealed. Nothing then allows it to be detected aesthetically that the partition is an earthquake-resistant partition.

When an earthquake occurs, the accelerations (forces) perpendicular to the partition are absorbed in particular by virtue of the good anchorage using the plugs 12 of the framework to the load-bearing members constituted by the floor 2 and the ceiling 4 as well as by the presence of the anchorage reinforcing member 16. Plugs 12 and anchorage reinforcing members 16 should be provided according to the load of the wall. In the case of a lightly loaded wall (covering boards of small thickness and no furniture or similar fixed onto the walls), a conventional framework fixing may be sufficient and the presence of anchorage reinforcing members is optional.

The horizontal accelerations in the plane of the partition are taken by the partition's structure itself.

The vertical accelerations in the plane of the partition are taken by virtue of the device described above, in addition to a conventional framework of a partition. These vertical accelerations may cause substantial deformation of flooring, in particular for high-load flooring or pre-stressed flooring. The partition described above accepts flooring deformations by virtue of the fact that the covering boards do not extend from the floor to the ceiling and the fact that the framework can absorb the deformations of the flooring. When vertical stresses appear, the slide may move vertically with respect to the top runner. The device so described enables separation of the covering boards with respect to the structure of the building in which the partition is made. The top runner ensures the holding, with respect to a movement with a component normal to the partition, of the slide and any framework of the partition with respect to the ceiling on which it is fixed, and ensures the guiding, with respect to a movement in a vertical direction, of the slide with respect to the ceiling.

The partition described here thus makes it possible to resist high stresses arising during an earthquake without damage. It also has the same acoustic and fire-resistant properties as a similar partition, that is to say using identical covering boards, vertical uprights and lower and upper rails. This is possible in particular by virtue of the protective strip being put in place in the rabbet of the top runner which ensures insulation between the two faces of the partition and avoids the presence of a bridge between those two faces despite the lack of continuity of the covering boards between the floor and the ceiling.

The device described above for connecting a partition to a ceiling may also be adopted, as presented, to provide the connection between that partition and vertical wall. A partition may then be equipped on three sides (or possibly only two) with an earthquake-resistant mounting device according to the invention.

To illustrate the mounting along a vertical wall, reference may be made to the upper part of FIG. 1, above the chain lines. If it is then considered that the plane of the cross-section is horizontal, this is an example of connection to a vertical wall. Reference 4 then corresponds to the vertical wall considered. Reference 10 corresponds to a vertical side rail. The top runner 30 of FIG. 1 may then represent a runner qualified here as vertical runner of identical form to that of the top runner 30.

The present invention is not limited to the preferred embodiment described above by way of non-limiting example. It also concerns all the variant embodiments within the capability of the person skilled in the art in the context of the claims given below.

Thus in the device described above, it is important to have a slide able to move relative to a top runner fixed onto a structural member, here termed ceiling. The form of the slide and top runner has been given by way of illustrative example. Other forms capable of holding and guiding may be envisaged for these members.

The materials indicated are given by way of example. Instead of using galvanized steel to produce the framework of a partition, other materials may be used, for example synthetic or composite materials. Similarly the covering used is not necessarily of plaster.

The embodiment enables the production cost of the earthquake-resistant partition described to be limited. It re-uses in particular the whole of the structure of a conventional partition framework. The use of specific profiled section member parts can also be envisaged for producing the framework. It can also be envisaged to provide a single member fulfilling both the function of the upper rail and of the slide.

The invention claimed is:

1. A device for the earthquake-resistant mounting of a partition between a floor (2) and a ceiling (4), said partition having a framework comprised of a lower rail (8) and an upper rail (10) that are substantially horizontal and configured to connect to substantially vertical uprights for connecting the upper and lower rails, the framework configured to fixably connect with a covering (6), the device comprising:

a slide (18) of profiled section, having arms (22) forming a substantially U-shaped section and configured to be joined to the upper rail (10);

a top runner (30) comprised of a rail with two side flanges (36) extending parallel to and within the arms (22) of the U-shaped section of the slide (18) such that the slide (18) and the top runner (30) are movable relative to each other in a vertical direction, the top runner being configured to be fixed to the ceiling (4); and reversible snap-fitting means between the slide (18) and the top runner (30), the snap-fitting means comprised of first and second matching bosses (26, 38), the first boss projecting inward respective of the flanges (36) of the top runner, and the second boss projecting inward respective of the arms of the slide, wherein the slide (18) and top runner (30) are each mounted to move relative to each other in a vertical direction, wherein the first boss (26) is configured, in a resting position, to locate in the second boss (38), and wherein the slide (18) comprises, at free ends of each of the arms (22) of the U-shaped section, a rim (24) extending outwardly of the U of the U-shaped section, substantially perpendicular to the arms (22) of the U.

2. The device according to claim 1, further comprising:

an elastic joint (48) adapted to be located between a rim (24) of the slide (18) and the ceiling (4) on which the top runner (30) is fixed.

3. A partition, comprising:

a device according to claim 1;

a substantially horizontal lower rail (8);

a substantially horizontal upper rail (10) connected to said device;

substantially vertical uprights connecting said lower rail (8) and said upper rail (10); and a covering (6) fixed to said upper and lower rails.

4. The partition according to claim 3, wherein an upper portion of the covering (6) is fixed so as not to extend beyond the slide (18) forming a free space between the covering (6) and the ceiling (4), said space configured to be filled by a joint (48) of elastic material.

5. The partition according to claim 3, wherein the covering boards (6) are mounted so as to be floating with respect to the lower rail (8).

6. The partition according to claim 3, wherein a flexible mastic joint (46) is provided between the floor (2) and the covering (6) fixed to the framework.

7. The partition according to claim 3, wherein at least one anchorage reinforcing member (16) is disposed transversely in the lower rail (8).

8. A device for the earthquake-resistant mounting of a partition between a floor (2) and a ceiling (4), said partition having a framework comprised of a lower rail (8) and an upper rail (10) that are substantially horizontal and configured to connect to substantially vertical uprights for connecting the upper and lower rails, the framework configured to fixably connect with a covering (6), the device comprising:

a slide (18) of profiled section, having arms (22) forming a substantially U-shaped section and configured to be joined to the upper rail (10);

a top runner (30) comprised of a rail with two side flanges (36) extending parallel to and within the arms (22) of the U-shaped section of the slide (18) such that the slide (18) and the top runner (30) are movable relative to each other in a vertical direction, the top runner being configured to be fixed to the ceiling (4); and reversible snap-fitting means between the slide (18) and the top runner (30), the snap-fitting means comprised of first and second matching bosses (26, 38), the first boss projecting inward respective of the flanges (36) of the top runner, and the second boss projecting inward respective of the arms of the slide, wherein the slide (18) and top runner (30) are each mounted to move relative to each other in a vertical direction, wherein the first boss (26) is configured, in a resting position, to locate in the second boss (38), and wherein the top runner (30) also comprises a housing (34), disposed between the side flanges (36), on the opposite side from the slide (18) configured to receive a material (35) having fire-retardant properties.

9. A device for the earthquake-resistant mounting of a partition between a floor (2) and a ceiling (4), said partition having a framework comprised of a lower rail (8) and an upper rail (10) that are substantially horizontal and configured to connect to substantially vertical uprights for connecting the upper and lower rails, the framework configured to fixably connect with a covering (6), the device comprising:

a slide (18) of profiled section, having arms (22) forming a substantially U-shaped section and configured to be joined to the upper rail (10);

a top runner (30) comprised of a rail with two side flanges (36) extending parallel to and within the arms (22) of the U-shaped section of the slide (18) such that the slide (18) and the top runner (30) are movable relative to each other in a vertical direction, the top runner being configured to be fixed to the ceiling (4);

reversible snap-fitting means between the slide (18) and the top runner (30), the snap-fitting means comprised of first and second matching bosses (26, 38), the first boss projecting inward respective of the flanges (36) of the top runner, and the second boss projecting inward respective of the arms of the slide; and at least one anchorage reinforcing member (16) disposed in the top runner (30), wherein the slide (18) and top runner (30) are each mounted to move relative to each other in a vertical direction, and wherein the first boss (26) is configured, in a resting position, to locate in the second boss (38).

10. The device according to claim 9, wherein said anchorage reinforcing member (16) is constituted by a U-section member disposed transversely with respect to the slide (18) and the top runner (30).

11. A partition, comprising:

a first rail (8) extending in a first direction;

a second rail (10) spaced from said first rail and extending in the first direction;

a device configured to mount said second rail (10) on a surface; and a body (6) extending between said first and second rails (8, 10) and fixed to said first and second rails (8, 10), wherein the second rail (10) is configured to join with said device, wherein the device is comprised of a slide (18) of profiled section with arms (22) forming a substantially U-shaped section configured to be joined to the second rail (10), a runner (30) configured to be fixed to the surface and comprised of a third rail with two side flanges (36) extending parallel to and within the arms (22) of the U-shaped section of the slide (18) such that the slide (18) and the runner (30) are movable relative to each other in the first direction, and reversible snap-fitting means between the slide (18) and the runner (30), the snap-fitting means comprised of first and second matching bosses (26, 38), the first boss projecting inward respective of the flanges (36) of the runner, and the second boss projecting inward respective of the arms of the slide, wherein the slide (18) and the runner are each mounted to move relative to each other in the first direction, and wherein the first boss (26) is configured, in a resting position, to locate in the second boss (38).

12. A device for earthquake-resistant mounting of a partition between a floor and a ceiling, comprising:

a framework comprised of a first rail that is substantially horizontal and connectable to a substantially vertical upright connectable to a second rail, the framework configured to fixably connect with a covering;

a slide of profiled section joined to the first rail along a vertical direction, the slide having two arms forming a substantially U-shaped section;

a runner rail, the slide being mounted to the runner rail, the runner rail having two side flanges extending parallel to and within the two arms of the U-shaped section of the slide, the runner rail being configured to be fixed to a horizontal surface, wherein the slide and runner rail are movable relative to each other in the vertical direction, and wherein the slide and the runner rail respectively have first and second bosses, the first boss located on the flanges of the runner rail, the second boss located on the arms of the U-shaped section of the slide, and wherein, in a resting position of the slide and the runner rail along the vertical direction, the first and second bosses are configured to reversibly engage with each other in reversible snap-fit enagement.

13. The device according to claim 12, wherein the slide comprises, at free ends of each of the arms of the U-shaped section, a rim extending outwardly of the U of the U-shaped section, substantially perpendicular to the arms of the U.

14. The device according to claim 13, further comprising: an elastic joint located between a rim of the slide (18) and the horizontal surface on which the runner rail is fixed.

15. The device according to claim 12, wherein the runner rail also comprises a housing disposed between the side flanges and on an opposite side from the slide, the housing configured to receive a material having fire-retardant properties.

16. The device according to claim 12, further comprising: at least one anchorage reinforcing member disposed in the runner rail.

17. The device according to claim 16, wherein said anchorage reinforcing member comprises a U-section member disposed transversely with respect to the slide and the runner rail.

* * * * *